United States Patent [19]

Van Rens et al.

[11] Patent Number: 4,763,039

[45] Date of Patent: Aug. 9, 1988

[54] COLOR DISPLAY TUBE WITH CORNER SUSPENSION MEANS

[75] Inventors: Piet C. J. Van Rens; Willem Van Der Hoek, both of Eindhoven, Netherlands

[73] Assignee: U.S. Philips Corporation, New York, N.Y.

[21] Appl. No.: 32,412

[22] Filed: Mar. 30, 1987

[30] Foreign Application Priority Data

Apr. 2, 1986 [NL] Netherlands ..... 8600832

[51] Int. Cl.[4] ..... H01J 29/07

[52] U.S. Cl. ..... 313/406

[58] Field of Search ..... 313/406, 404

[56] References Cited

U.S. PATENT DOCUMENTS 4,644,222 2/1987 Brunn ..... 313/406

FOREIGN PATENT DOCUMENTS 0109344 8/1980 Japan ..... 313/406

1304567 1/1973 United Kingdom ..... 313/406

*Primary Examiner*—Palmer C. DeMeo

*Attorney, Agent, or Firm*—John C. Fox

[57] ABSTRACT

The invention relates to a color display tube having a color selection electrode which is suspended in the tube by engagement of apertured elements connected to flat resilient elements extending from the corners of the electrode, with the spherical heads of pins extending from the corners of the display window. According to the invention, a rigid construction is obtained by providing apertures shaped so that each spherical part has at least three points of engagement with its respective apertured element, and at least one point of engagement is outside the plane of the flat resilient element.

8 Claims, 4 Drawing Sheets

COLOR DISPLAY TUBE WITH CORNER SUSPENSION MEANS

BACKGROUND OF THE INVENTION

The invention relates to a color display tube comprising an envelope having a substantially rectangular display window with an upright edge, a substantially rectangular color selection electrode having a large number of apertures, and suspension means for suspending the color selection electrode in the corners of the upright edge of the display window, the suspension means comprising at each corner two parts, the first part comprising a flat resilient element connected to the color selection electrode, which element is substantially perpendicular to the electron beam paths at the corner regions, and the second part comprising a metal member in the corner of the upright edge, one of the parts having an aperture and the other of the parts having a spherical portion engaging the aperture.

A color display tube of the type mentioned in the opening paragraph is disclosed in published European Patent Application EP-A2 No. 0156362.

In the color display tube described in the Application, the first part comprising the flat resilient element has an aperture, and the second part comprising the metal member has a metal pin which at one end is sealed in the corner of the upright edge of the display window, and at the other (free) end has a spherical portion engaging the aperture, the flat resilient element at the area of the aperture being pressed against the spherical portion by means of a spring.

In practice, such a construction has proved to have the disadvantage of being insufficiently rigid, as a result of which undesired movement of the color selection electrode relative to the display window is possible.

One of the objects of the invention is to avoid this disadvantage.

SUMMARY OF THE INVENTION

The color display tube mentioned in the opening paragraph is characterized according to the invention in that the center of the spherical portion is situated substantially in the center of the aperture, and the spherical portion has at least three points of engagement with the aperture, the points of engagement defining a circular cross section having a circumference smaller than the circumference of the spherical portion, and at least one point of engagement situated outside the plane of the flat resilient element, on the side of the element facing away from the part having the spherical portion.

It has been found that a color display tube of such a construction has sufficient rigidity in practice.

One embodiment of the color display tube of the invention is characterized in that the aperture is defined by an element comprising a hollow tapered portion such as a truncated cone or pyramid having at least three sides. Preferably, the aperture-defining element is located in the part comprising the flat resilient element, and the hollow tapered portion extends above an opening in the plane of the flat resilient element on the side away from the part having the spherical portion. In this manner a rigid construction of the color selection electrode is obtained in a particularly simple manner.

Should the spherical portion move in the pyramidal element, such movement can easily be countered by an upright retaining wall extending downward from the lower edge of the hollow tapered portion through the opening in the flat resilient element.

The opening which is formed by the retaining wall may have a smaller cross-section than that of the spherical portion, in order to enhance its ability to counter such movement.

A further embodiment of the color display tube in accordance with the invention is characterized in that the aperture is defined by an element comprising two flat sections joined by a transverse bend through substantially the center of the aperture. The element may either be an extension of the flat resilient element connected to the color selection electrode, or may be attached to the metal member in the corner of the display window.

BRIEF DESCRIPTION OF THE DRAWINGS

The invention will now be described in greater detail with reference to three exemplary embodiments and the accompanying drawing in which.

DESCRIPTION OF THE PREFERRED EMBODIMENTS

Figure 1:
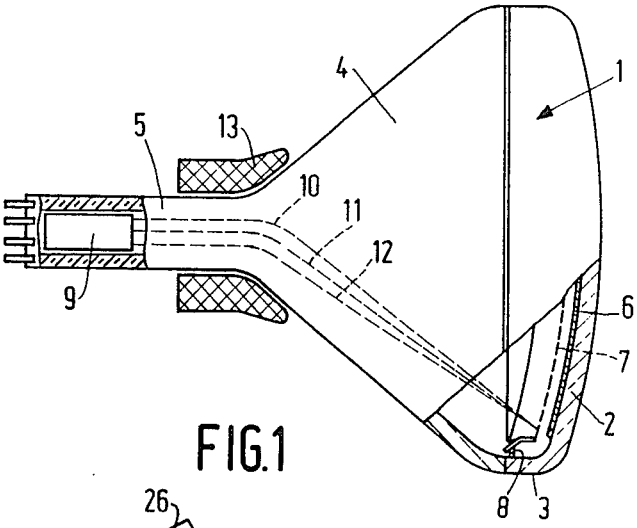
FIG. 1 is a diagrammatic view, partly in section, of a color display tube according to the invention.

The color display tube shown in FIG. 1 comprises an envelope 1 having a substantially rectangular display window 2 comprising an upright edge 3. The color display tube furthermore comprises a cone 4 and a neck 5. A pattern of phosphors 6 luminescing in the colors red, green and blue is provided on the display window 2.

At a short distance from the display window 2 a substantially rectangular color selection electrode 7 having a large number of apertures is suspended from the corners of the upright edge 3 by suspension means 8.

The suspension means comprise at each corner two parts, the first part including a flat resilient element connected to the color selection electrode 7, which element is substantially perpendicular to the electron beam paths 10, 11 and 12 at the corner regions, and the second part being a metal member in the corners of the upright edge 3 of the display window 2.

An electron gun 9 for generating three electron beams 10, 11 and 12 is mounted in the neck 5 of the tube. These beams are deflected by means of a system of coils 13 placed around the tube, and the beams intersect each other substantially at the area of the color selection electrode 7, after which each of the beams impinges upon one of the three phosphors provided on the display screen.

Figure 5:
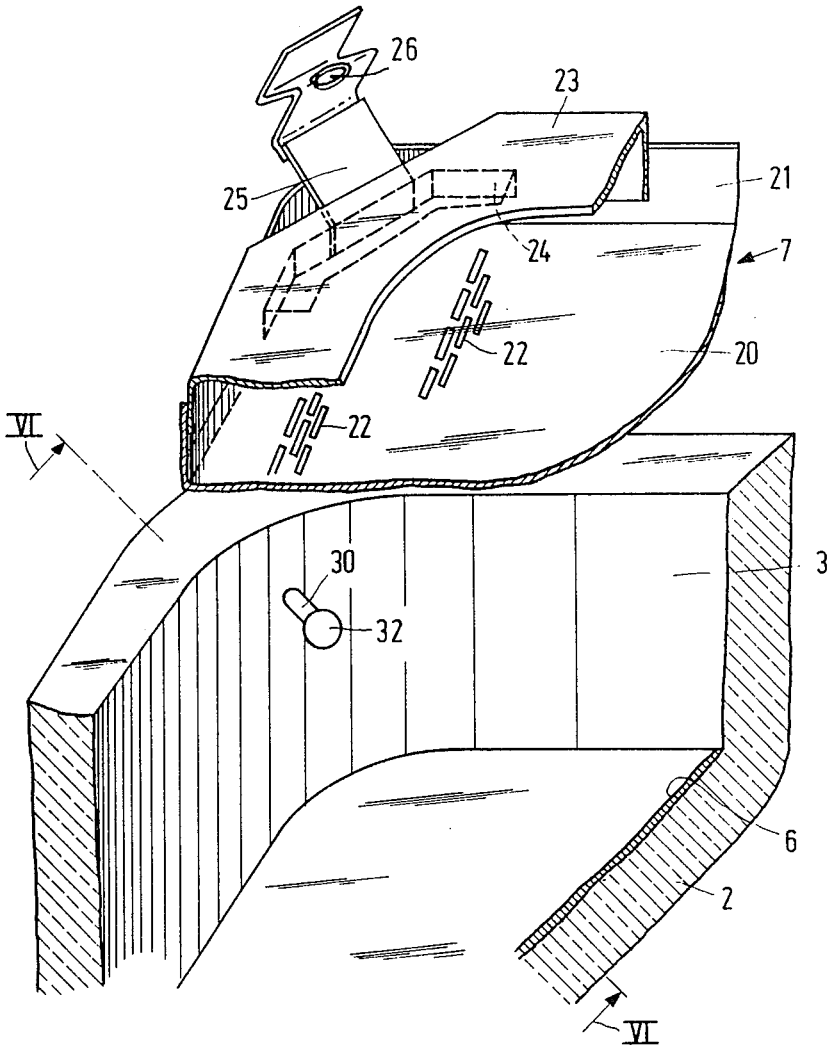
FIG. 5 is a diagrammatic perspective exploded view of a portion of the color display tube of FIG. 1 showing a second embodiment of the invention.
Figure 6:
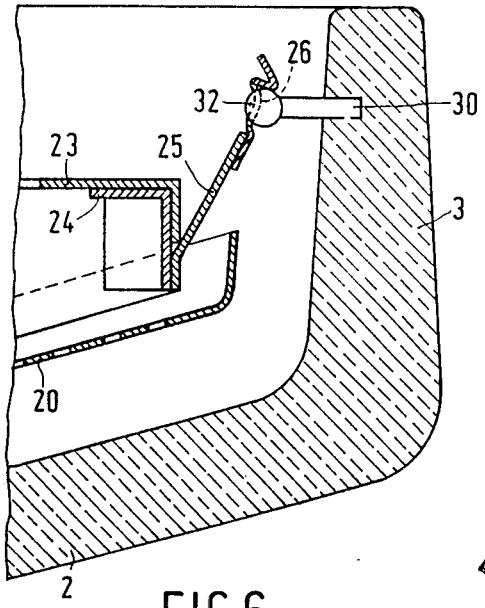
FIG. 6 is a sectional view taken on the line VI—VI of FIG. 5, with the color selection electrode in position.
Figure 7:
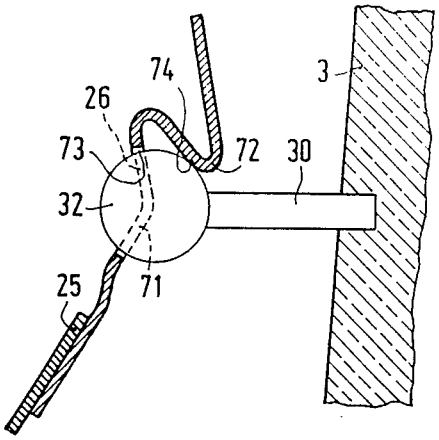
FIG. 7 is a detail of the sectional view of FIG. 6.
Figure 8:
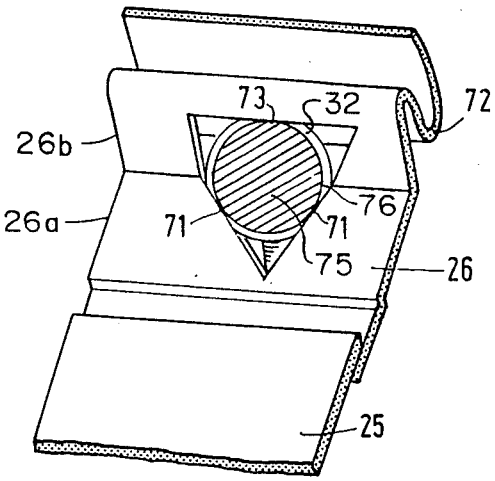
FIG. 8 is a diagrammatic perspective view of FIG. 7.

The color selection electrode 7 (see FIGS. 2 and 5) is formed of a thin mask sheet 20 which has a large number of apertures 22 and an upright edge 21. A mask frame 23 is connected to the upright edge 21 and also forms a shield to prevent reflections of electrons at the upright edge 21.

In order to avoid differences in expansion between the mask sheet 20 and the mask frame 23, both are manufactured from the same material and have approximately the same thickness. A supporting strip 24 is connected to the corner of the mask frame 23. The flat resilient element 25 is connected to said supporting strip 24. The flat resilient element 25 encloses such an angle with the longitudinal axis of the tube that it is substantially perpendicular to the electron beam paths 10, 11 and 12 at the corner regions of the display window.

In the embodiments of FIGS. 2 through 8, the aperture is located in the first part comprising the flat resilient element 25, and the spherical portion 32 is located in the second part comprising the pin 30, provided in the corner of the upright edge of the display window.

Figure 2:
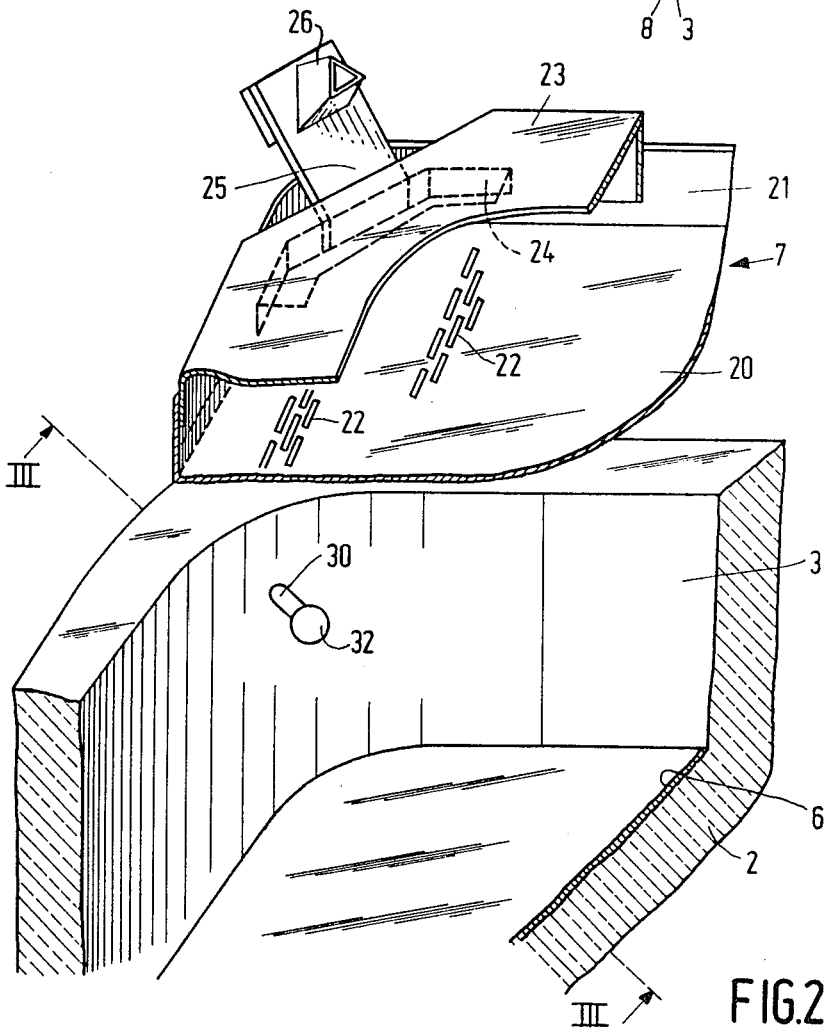
FIG. 2 is a diagrammatic perspective exploded view of a portion of the color display tube of FIG. 1, showing a first embodiment of the invention.
Figure 3:
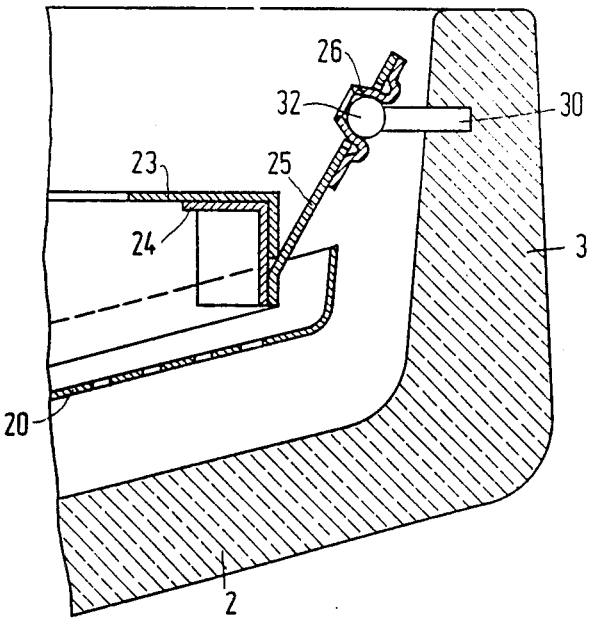
FIG. 3 is a sectional view taken on the line III—III in FIG. 2 with the color selection electrode in position.
Figure 4:
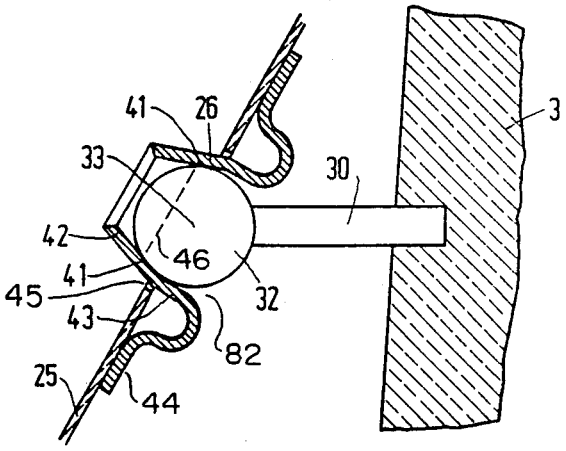
FIG. 4 is a detail of the sectional view of FIG. 3.

In the embodiment of FIGS. 2 through 4, the aperture is defined by a truncated pyramidal structure represented by hollow tapered portion 26, protruding through an opening 45 in the flat resilient element 25 and including wall 43 extending downward through the opening and terminating in planar portions 44, which contact flat resilient element 25 and limit the extent that tapered portion 26 protrudes through opening 45. The cross section of the hollow tapered portion 26 may be triangular, as shown, but may also be, for example, a polygon having more than three sides.

In order to minimize movement of the color selection electrode 7 with respect to the display window and to increase the rigidity of the construction, the spherical part 32 of the metal member 30 in the color display tube in accordance with the invention has at least three points of engagement 41 with the aperture of the flat resilient element 25, depending on the cross section of the hollow tapered part 26, and the center 33 (see FIG. 4) of the spherical part 32 is situated substantially in the center of the aperture. The points of engagement lie in a cross-section of the spherical portion indicated as dashed line 46, extending between points of engagement 41 in FIG. 4. At least one point of engagement is situated on the side of the flat resilient element that is opposite to the metal member 30, and thus at least one point of engagement is situated outside the plane of the flat resilient element 25.

In the first embodiment of the color display tube according to the invention all three points of engagement 41 are situated on the side remote from the metal member (pin) 30 and outside the plane of the flat resilient element 25.

Figure 9:
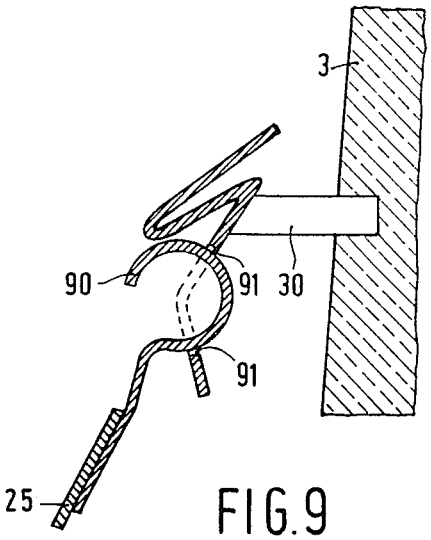
FIG. 9 is a detailed sectional view of a third embodiment of the invention.

The spherical part 32 cannot easily spring from the aperture 42 due to upright retaining wall 43 at the bottom edge of the aperture 42. Upright wall 43 may have a smaller cross-section than the circumference of spherical portion 32. That is, it acts as a detent. The aperture 42 may be closed on the side remote from the pin. In the second embodiment of the color display tube according to the invention (FIGS. 5, 6, 7 and 8) the aperture is situated partly in each of two flat portions 26*a* and 26*b* of an extension 6 of the flat resilient element 25. Two points of engagement are situated at 71 in the flat part 26*a* and one point of engagement at 73 in flat portion 26*b*. The points of engagement lie in a cross-section of the spherical portion indicated as area 75 extending between points of engagement 71 and 73 defined by circle 76 in FIG. 8. In this embodiment also there is an upright edge or abutment 72 having a point of engagement 74. Although the apertured element is shown in FIGS. 5 through 8 to be an extension of the flat resilient element 25, the invention also relates to constructions in which, for example, the spherical part 90 may be connected to the flat resilient element and the aperture 91 may be connected to the metal member (the pin 30) as is shown in FIG. 9.

It will be obvious that many variations are possible to those skilled in the art without departing from the scope of this invention. For example, instead of a pin, the metal member may also be a bridge, connected for example by thermocompression bonding over the corner of the upright edge of the display window, to which the spherical portion or an apertured element is connected.

What is claimed is:

1. A color display tube comprising an envelope having a substantially rectangular display window with an upright edge, a substantially rectangular color selection electrode having a large number of apertures, and suspension means for suspending the color selection electrode in the corners of the upright edge, said suspension means comprising at each corner two parts, a first part comprising a flat resilient portion connected to the color selection electrode, which portion is substantially perpendicular to the electron beam paths at the corner regions, and a second part being a metal member in the corners of the upright edge of the display window, one of the parts having an aperture defined therein and the other part having a spherical portion engaging said one part in said aperture, characterized in that: the aperture is defined in a non-flat portion of one of the parts; the center of the spherical portion is situated substantially in the center of the aperture; the spherical portion has at least three points of engagement with said one part in the aperture; the points of engagement define a circular cross-section having a circumference smaller than the circumference of the spherical portion; and at least one point of engagement is situated outside the plane of the flat resilient portion.

2. A color display tube as claimed in claim 1, wherein the aperture is defined by a hollow tapered portion.

3. A color display tube as claimed in claim 2, wherein the hollow tapered portion is a truncated pyramid having at least three sides.

4. A color display tube as claimed in claim 2, wherein the hollow tapered portion is located in the part comprising the flat resilient portion connected to the color selection electrode, and wherein the hollow tapered portion extends above an opening in the plane of the flat resilient portion on the side away from the other part having the spherical portion.

5. A color display tube as claimed in claim 4, wherein an upright retaining wall extends downward from the lower edge of the hollow tapered portion through the opening in the flat resilient portion.

6. A color display tube as claimed in claim 1, wherein the aperture is defined by two flat sections joined by a transverse bend substantially through the center of the aperture.

7. A color display tube as claimed in claim 6, wherein the two flat sections are extensions of the flat resilient portion.

8. A color display tube as claimed in claim 6, wherein the two flat sections comprise a separate element attached to the metal member in the corner of the display window.

* * * * *